US008476992B2

(12) United States Patent
Yang et al.

(10) Patent No.: US 8,476,992 B2
(45) Date of Patent: Jul. 2, 2013

(54) CIRCUIT BREAKER HAVING AN UNLOCKING MECHANISM AND METHODS OF OPERATING SAME

(75) Inventors: Guang Yang, Suwanee, GA (US); Timothy Biedrzycki, Powder Springs, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 13/267,932

(22) Filed: Oct. 7, 2011

(65) Prior Publication Data

US 2013/0088310 A1 Apr. 11, 2013

(51) Int. Cl.
*H01H 75/00* (2006.01)

(52) U.S. Cl.
USPC ..... 335/6; 335/167

(58) Field of Classification Search
USPC ..... 335/6
See application file for complete search history.

(56) References Cited

U.S. PATENT DOCUMENTS 2,887,548 A * 5/1959 Middendorf ..... 337/76
4,048,607 A * 9/1977 Smorzaniuk ..... 337/53
4,998,081 A * 3/1991 Boyd ..... 335/6
6,921,873 B2 7/2005 Puskar
7,113,062 B2 9/2006 Carton
7,391,289 B2 6/2008 Holland
2003/0016101 A1 * 1/2003 Germain et al. ..... 335/6
2008/0214053 A1 9/2008 Hoehne
2009/0189719 A1 7/2009 Yang

OTHER PUBLICATIONS

PCT International Search Report mailed Feb. 1, 2012 corresponding to PCT International Application No. PCT/US2011/055563 filed Oct. 10, 2011 (11 pages).

* cited by examiner

*Primary Examiner* — Elvin G Enad
*Assistant Examiner* — Lisa Homza

(57) ABSTRACT

Embodiments provide an electronic circuit breaker. The electronic circuit breaker has a moveable contact arm having a moveable main electrical contact, and a lockout mechanism operable to contact the moveable contact arm and block motion of thereof, the lockout mechanism having a lockout latch with one or more pivot joints, a moveable stop, and an offset engagement portion, the moveable stop adapted to contact the moveable contact arm, and an unlock actuator providing an unlock force at the engagement portion causing lockout latch pivoting and release of the moveable contact arm. Also disclosed are secondary electrical contacts configured to engage each other in the ON configuration, with a leaf spring operably supporting a moveable one of the secondary contacts, the leaf spring configured to be flexed to close the secondary contacts. A method of operating the electronic circuit breaker is provided, as are other aspects.

3 Claims, 9 Drawing Sheets

CIRCUIT BREAKER HAVING AN UNLOCKING MECHANISM AND METHODS OF OPERATING SAME

FIELD OF THE INVENTION

The present invention relates generally to a circuit breaker for interrupting current from an electrical power supply, and more particularly to a circuit breaker including an unlocking mechanism.

BACKGROUND OF THE INVENTION

Circuit breakers are used in certain electrical systems for protecting an electrical circuit coupled to an electrical power supply. For example, electronic circuit breakers, such as Arc Fault Circuit Breakers (AFCIs), Ground Fault. Circuit. Interrupters (GFCIs), Transient Voltage Surge Suppressors (TVSSs), and surge protectors, use electronic components to detect certain types of faults, such as arc faults and ground faults.

If one or more of the electronic components in such a circuit breaker fails in some way, the circuit breaker may be unable to electrically protect the one or more electrical branch circuits that are connected to the circuit breaker. Accordingly, it would be desirable to check the electronic circuit or electronic components of the circuit breaker prior to closing the main contacts of the circuit breaker.

SUMMARY OF THE INVENTION

In a first aspect, an electronic circuit breaker is provided. The electronic circuit breaker includes a moveable contact arm having a moveable main electrical contact, and a lockout, mechanism operable to cause contact with the moveable contact arm and block motion of the moveable main electrical contact, the lockout mechanism having a lockout latch having one or more pivot joints operatively pivotal about a pivot axis on a first end, a moveable stop on a second end, and an engagement portion offset from the pivot axis, the moveable stop adapted to contact the moveable contact arm, and an actuator operative to provide an unlock force at the engagement portion causing pivoting of the lockout latch about the pivot axis and release of the moveable contact arm.

in another aspect, an electronic circuit breaker is provided. The electronic circuit breaker includes main electrical contacts configurable between an opened and closed condition, the main electrical contacts including a moveable main electrical contact coupled to a moveable contact arm, a handle moveable between at least an ON configuration and an OFF configuration whereas motion of the handle causes motion of the moveable contact arm; and a lockout mechanism configured and operable to normally block motion of the moveable contact arm, the lockout mechanism having a lockout latch having one or more pivot joints pivotal about a pivot axis on a first end, a moveable stop on a second end, an engagement portion, and an actuator configured and operative to provide an unlock force at the engagement portion causing pivoting of the lockout latch to cause the moveable stop to release the moveable contact arm.

In another aspect, an electronic circuit breaker is provided. The electronic circuit breaker includes main electrical contacts configurable between an opened and closed condition, a handle coupled to the moveable contact arm to enable movement of the moveable contact arm, the handle moveable between at least an OFF configuration an ON configuration, secondary electrical contacts configured to engage each other when the handle is in the ON configuration, and a leaf spring operably supporting a moveable electrical secondary contact, the leaf spring configured. to be flexed to close the secondary electrical contacts in the ON configuration.

According to another aspect, a method of operating an electronic circuit breaker is provided. The method includes providing a moveable contact arm having a moveable main electrical contact, providing unlock mechanism having a lockout latch having one or more pivot joints operatively pivotal about a latch pivot axis on a first end, a moveable stop on a second end adapted to contact the moveable contact arm, an engagement portion offset from the pivot axis, and an unlock actuator, and actuating the actuator to provide an unlock force at the engagement portion causing pivoting of the lockout latch about the pivot axis and movement of the moveable stop thereby releasing the moveable contact arm to a closed configuration.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the spirit and scope of the claimed invention.

FIG, 2 is a top view of an embodiment of lockout assembly for a circuit breaker shown in a locked configuration.

Figure 3:
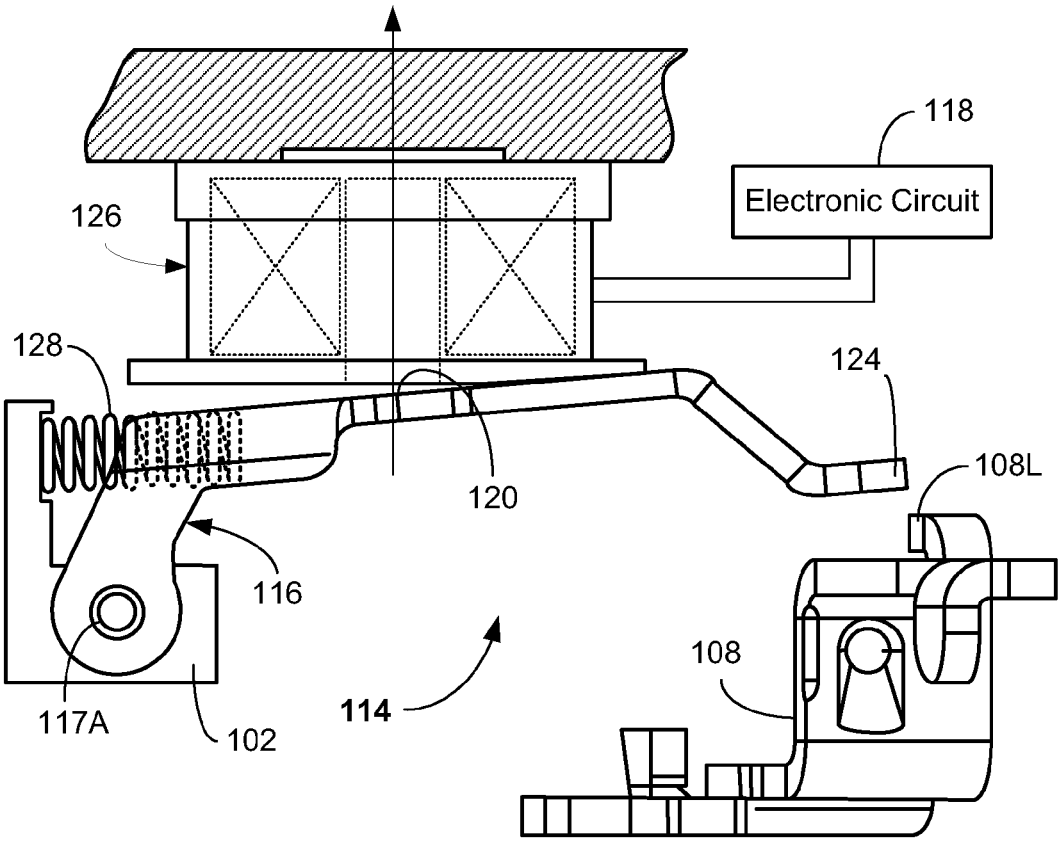

FIG. 3 is a top view of a lockout assembly shown in an unlocked configuration allowing a moveable contact arm to continue to a released ON configuration thereby closing the main electrical contacts.

Figure 4A:
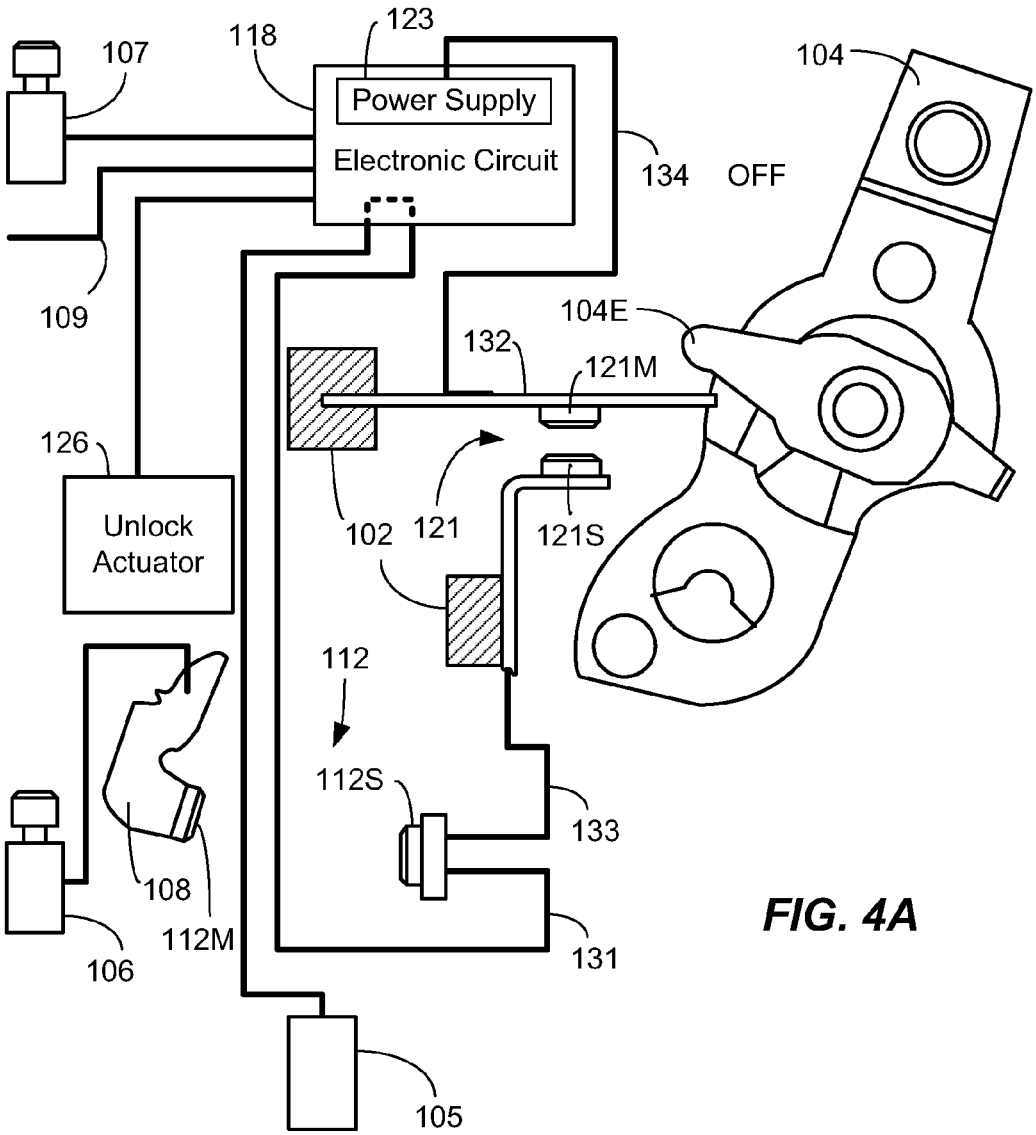

FIG. 4A is a side view of several components of a circuit breaker shown in an OFF configuration with both the main and secondary electrical contacts being open.

Figure 4B:
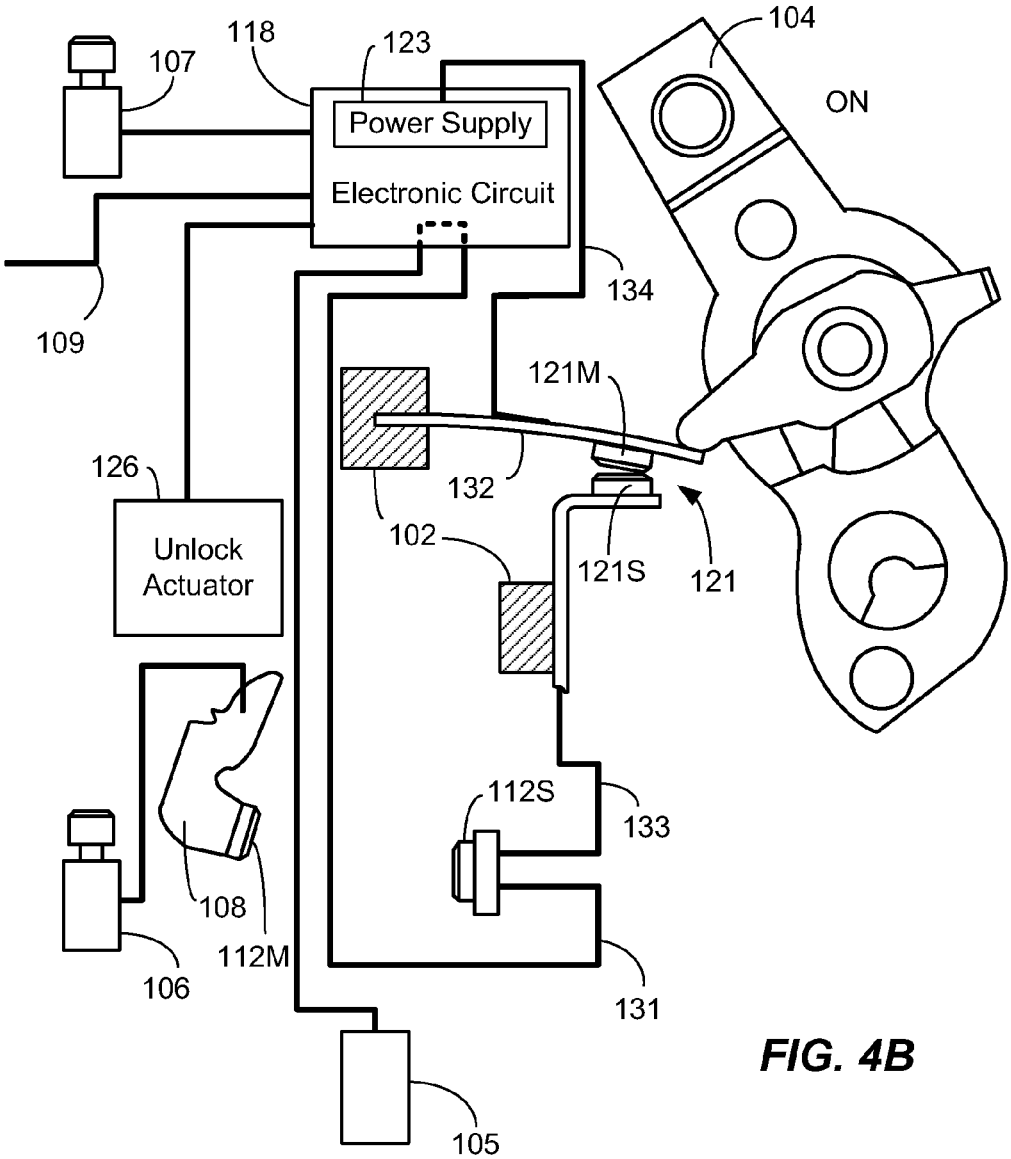

FIG. 4B is a side view of several components of a circuit breaker shown in an unreleased ON configuration with the main electrical contacts being open and secondary electrical contacts being closed.

Figure 4C:
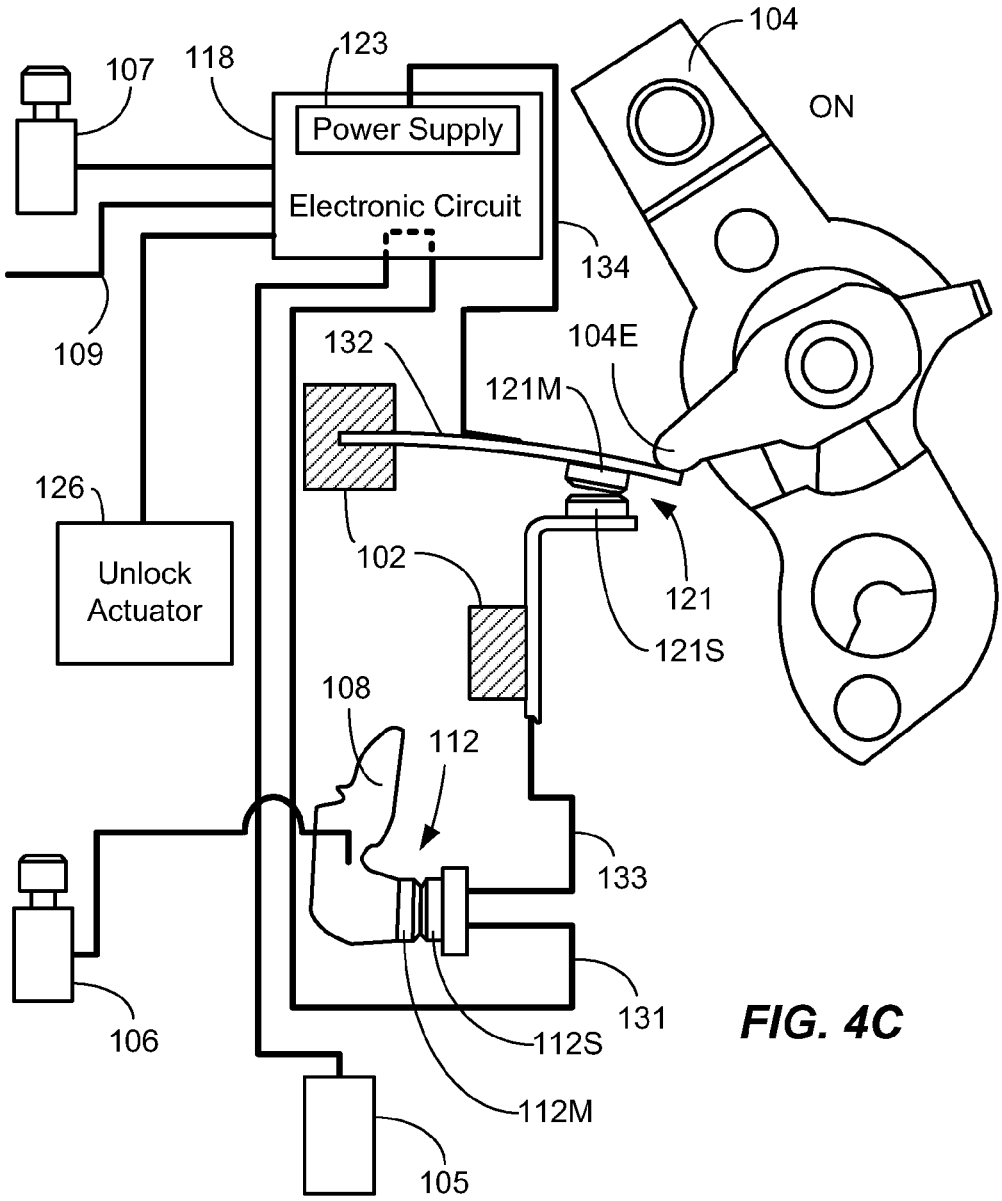

FIG. 4C is a side view of several components of a circuit breaker shown in a released ON configuration with both the secondary and main electrical contacts being closed following a passed self test.

Figure 5A:
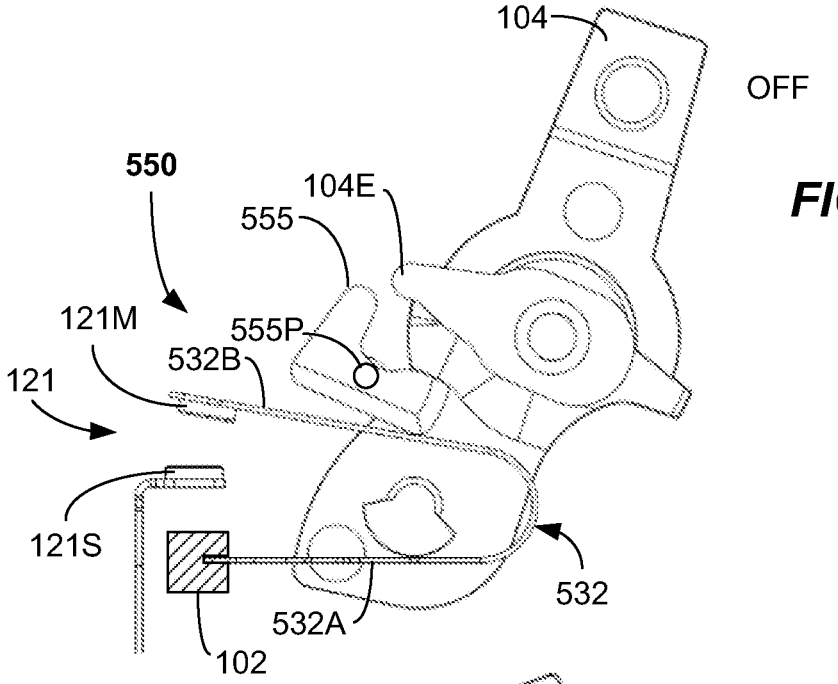
Figure 5B:
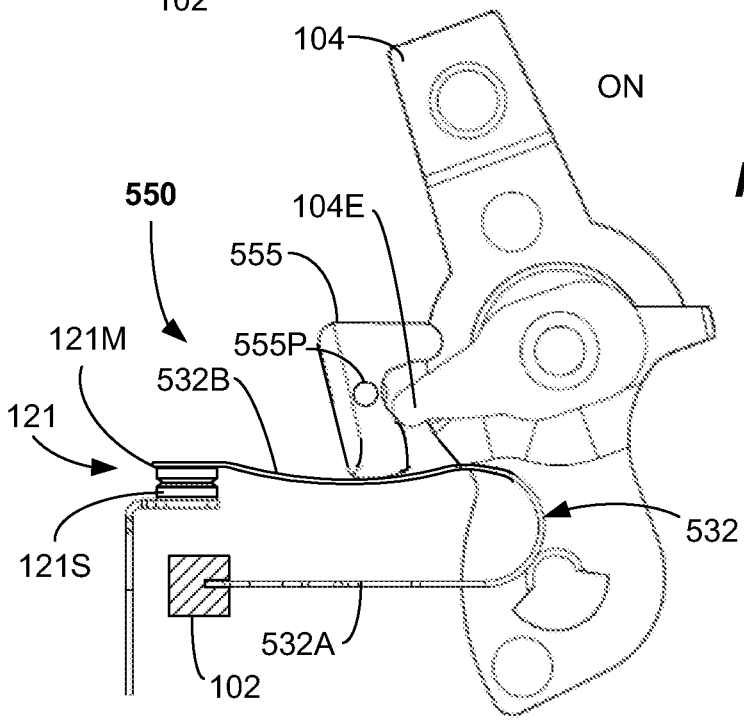

FIGS. 5A and 5B are side views of several components of a circuit breaker shown in an OFF configuration with the secondary electrical contacts being open, and the ON configuration with the secondary electrical contacts being closed (dotted), respectively.

Figure 6:
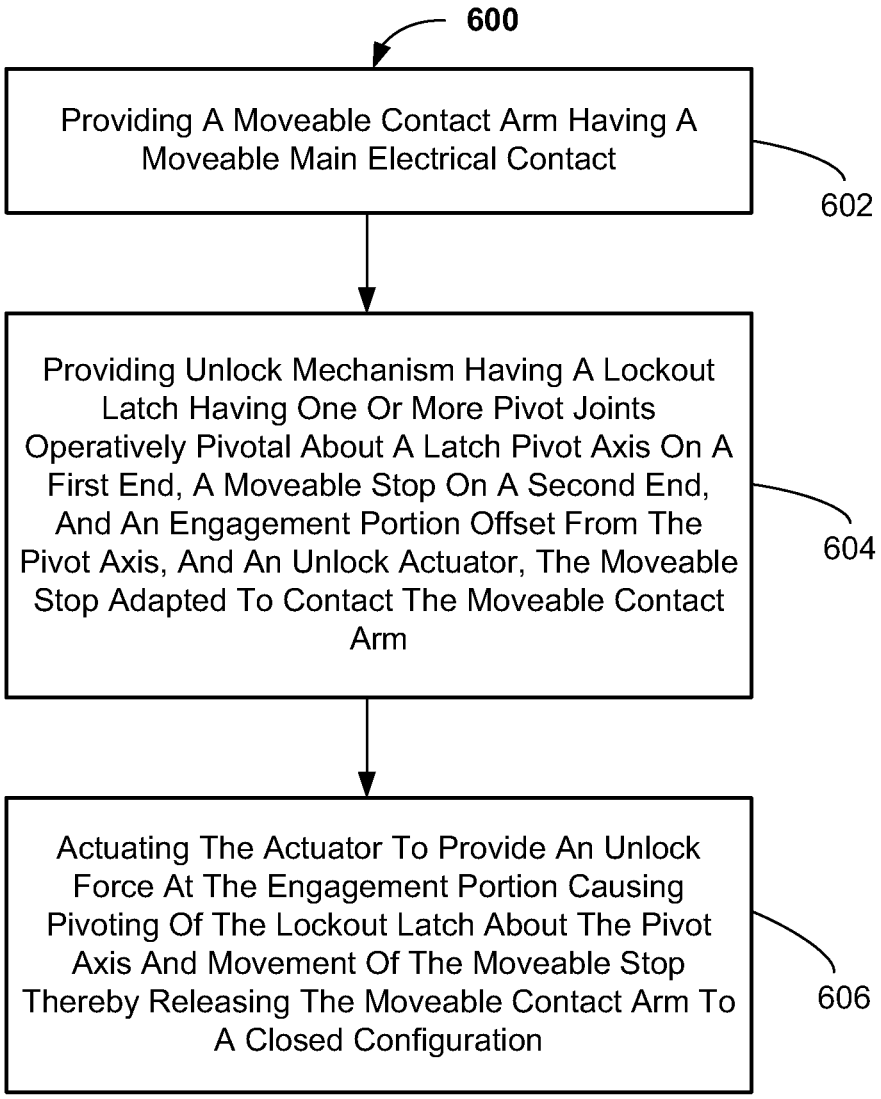

FIG. 6 is a flowchart illustrating a method of operating an electronic circuit breaker according to embodiments.

DETAILED DESCRIPTION

In view of the foregoing difficulties, a circuit breaker is provided that has a unlocking mechanism with a moveable stop adapted to allow locking and unlocking of a moveable contact arm of the circuit breaker. In particular, the unlocking mechanism is locked as the handle is moved toward an ON configuration. The electronic circuit breaker includes main electrical contacts and secondary electrical contacts. According to one aspect, closing of the secondary electrical contacts is accomplished in the ON configuration. Secondary electrical contact closing may be used to initiate powering of the internal electronic circuit of the circuit breaker. Once powered, a self test may be carried out on the internal electronic circuit of the circuit breaker in the locked state. If the self test is passed, then the moveable contact arm may be unlocked. through disengaging the moveable stop of the unlocking mechanism from the moveable contact arm. This allows the moveable contact arm to move so that the main electrical contacts may be closed. In contrast, if the electronic circuit breaker is determined to have a failed internal electronic circuit and/or electronic component as a result. of a failed self test, then the moveable contact arm and unlocking mechanism remain in a locked configuration.

According to one aspect, the electronic circuit breaker includes a lockout mechanism. operable to cause contact with the moveable contact arm and block motion of the moveable main electrical contact. The lockout mechanism has a lockout latch having one or more pivot joints operatively pivotal about a pivot axis, a moveable stop, and an engagement portion offset from the pivot axis, wherein the moveable stop is adapted to contact the moveable contact arm. An unlock actuator is operative to provide an unlock force at the engagement portion causing pivoting of the lockout latch about the pivot axis and allowing release of the moveable contact arm.

In another broad aspect, an electronic circuit breaker is provided. The circuit breaker includes secondary electrical contacts configured to engage each other when a handle of the circuit breaker is in the ON configuration, and a leaf spring operably supporting a moveable one of the secondary electrical contacts, wherein the leaf spring is configured to be flexed to close the secondary electrical contacts in the ON configuration.

Advantageously, the present invention enables the ability to immediately provide power to the electronic circuit of the circuit breaker when the circuit breaker is in the ON configuration (both unreleased and released ON configurations). Furthermore, the present invention simplifies the construction of the mechanisms by eliminating the need to reopen the secondary contacts as the circuit breaker handle is moved from an OVER ON configuration to the ON configuration, as was required in US Pub. No. 2009/0189719 entitled "Circuit Breaker Locking And Unlocking Mechanism," the disclosure of which is hereby incorporated by reference in its entirety herein.

The present invention is not limited to the illustrative examples for single-pole electronic circuit breakers described herein, but is equally applicable to of types of electronic circuit breakers. For example, this aspect of present invention may be useful with other circuit breakers, such as two-pole electronic circuit breakers, surge protective devices such as transient voltage surge protection (TVSS) devices, metering circuit breakers, electronic trip unit circuit breakers, and remotely controllable circuit breakers, for example. Other types of circuit breakers including single or multiple electrical branches may benefit as well.

These and other embodiments of electronic circuit breakers and methods of operating the electronic circuit breaker of the present invention are described below with reference to FIGS. 1-6. The drawings are not necessarily drawn to scale. Like numerals are used throughout the specification to denote like elements.

Figure 1A:
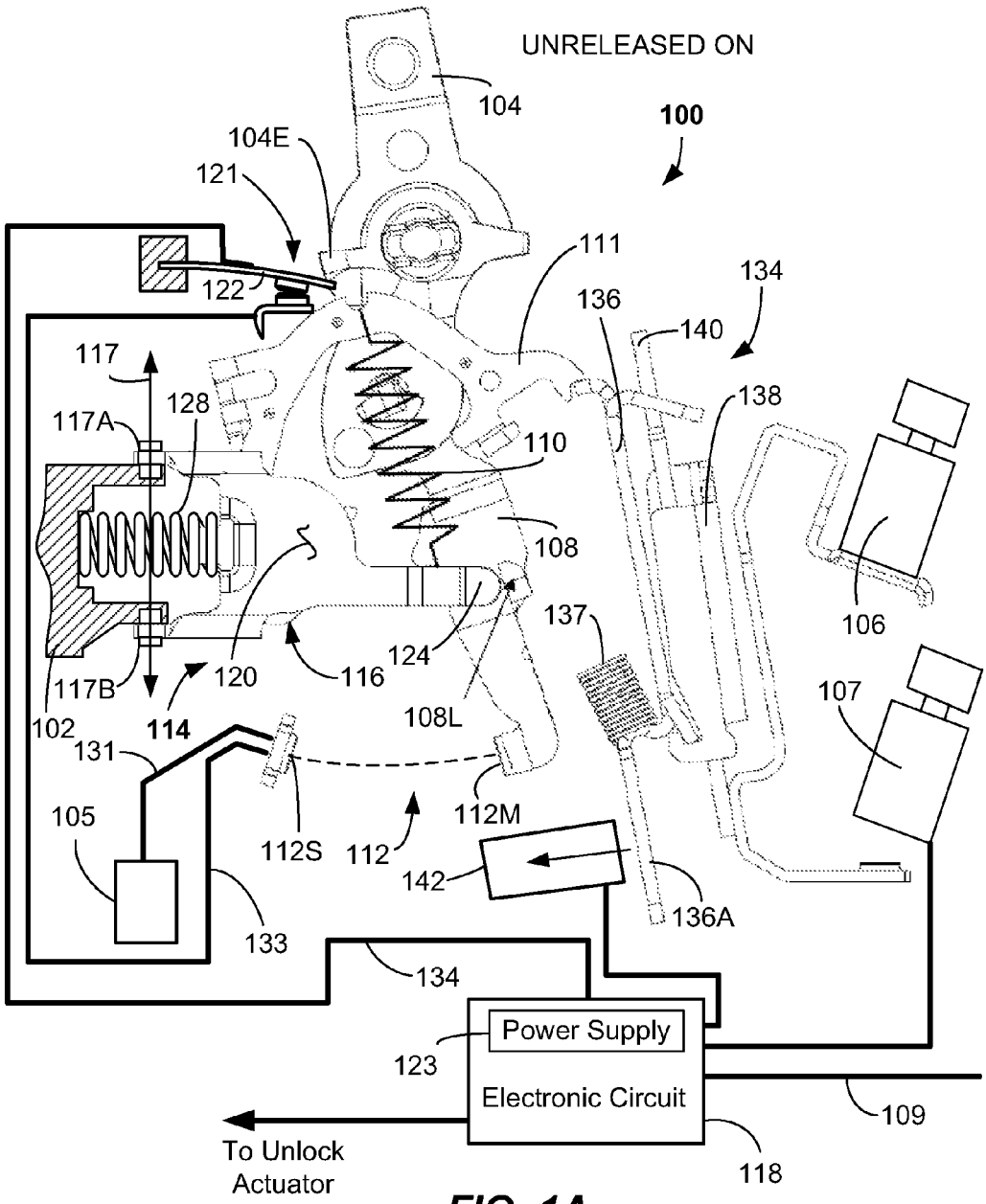
FIG. 1A is a side view of several components of an embodiment of circuit breaker shown in an unreleased ON configuration.
Figure 1B:
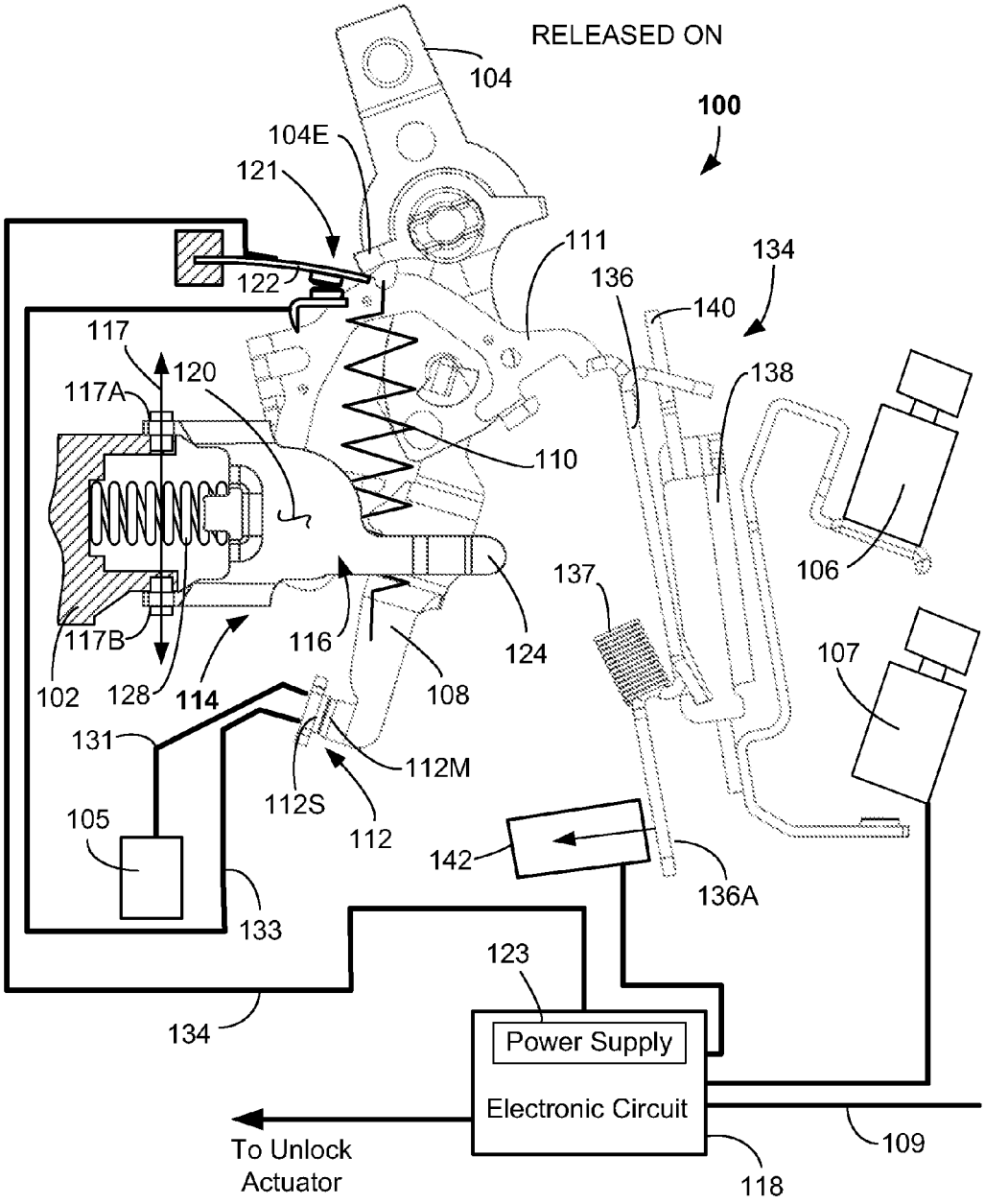
FIG. 1B is a side view of a circuit breaker shown in a released ON configuration with both the main electrical contacts being closed.

Referring now in specific detail to FIGS. 1A-1B, an electronic circuit breaker 100 is shown. Some portions of the housing are not shown to aid in understanding of the novel and unobvious features of the invention. The electronic circuit breaker 100 will be referred to herein as "electronic circuit breaker" or just "circuit breaker." The electronic circuit breaker 100 includes a housing 102, which may be formed from several molded housing portions. In the depicted embodiment of a single-pole circuit breaker, left and right housing portions may interconnect with each other via multiple fasteners (e.g., rivets) to form the housing 102 and internal spaces and surfaces to contain, mount, and retain the other circuit breaker components. The housing 102 may be made from any suitable rigid plastic, such as thermoset plastic material (e.g., polyester). Other materials may be used. Furthermore, other means of fastening the portions together may be used, such as screws, plastic welding, or adhesive. Furthermore, a higher number of housing portions may be used to form the housing 102. For example, in a two-pole electronic circuit, breaker, two mechanical poles are provided in first and second housing portions, and the internal electronic circuit may be housed in a third center housing section.

The electronic circuit. breaker 100 includes a handle 104 adapted to switch the various breaker components between at least ON and OFF configurations, with the unreleased ON configuration being shown in FIG. 1A, and the released ON configuration be shown in FIG. 1B. The circuit breaker may also be configured in a TRIP and RESET configuration (not shown). The handle 104 may be used to manually switch the electronic circuit breaker 100 from the OFF configuration to the unreleased ON configuration. Further, the handle 104 may reset the electronic circuit breaker 100 from a TRIP configuration (not shown.). Handle 104 may also be manufactured. (e.g., molded) from a suitable polymer material (e.g. a thermoplastic).

In the depicted embodiment, a power terminal 105 is provided, that may be configured to couple to a conventional stab, for example. The power terminal 105 may have a U-shaped form and may couple to a stab provided at a single standard circuit breaker location in a load center. Optionally, a standard assembly including a lug and lug screw may be employed. The term "load center" as used herein refers to any component that includes the ability to distribute electrical power to multiple electrical branch circuits, and which is adapted to receive and mount one or more circuit breakers to protect those electrical branch circuits.

A load terminal 106 is also provided and is adapted to be operationally connected to an electrical branch/electrical load (not shown). A load neutral terminal 107 may be provided and may be connected to a load neutral of the protected electrical circuit branch. The electronic circuit breaker 100 may also include neutral pigtail 109 adapted to be secured to a load center neutral (e.g., neutral bar), for example. The handle 104 may operationally interface with a moveable contact arm 108 through a conventional pivot and move the contact arm 108 from an OFF configuration (not shown) to an unreleased ON configuration shown in FIG. 1A. Spring 110 is coupled between the arm 108 and a cradle 111 and provides the spring force to keep the circuit breaker 100 in the selected configuration (released. ON, OFF, TRIP). The spring 110 and cradle 111 are of conventional construction.

Main electrical contacts 112, including a moveable main electrical contact 112M and a stationary main contact 112S, engage and disengage each other depending upon the configuration of the circuit breaker 100 (e.g., unreleased ON, released ON, OFF, TRIP) thereby making the main electrical contacts 112 configurable between an opened and closed condition. In the unreleased ON configuration shown in FIG. 1A, the main electrical contacts 112 are separated from each other thereby opening any attached protected electrical circuit branch. In the depicted embodiment of electronic circuit breaker 100 shown, secondary electrical contacts 121 are also provided. The secondary electrical contacts 121 include a stationary secondary electrical contact 121S and a moveable secondary electrical contact 121M. In the OFF configuration, the secondary electrical contacts 121 are opened (not engaged), and, thus, no power is provided to the internal, electronic circuit 118 of the electronic circuit breaker 100. However, as the handle 104 is moved to the unreleased ON configuration shown in FIG. 1A, the handle 104 contacts and flexes a leaf spring 122 to cause electrical contact between the secondary contacts 121. The present invention circuit breaker 100 also includes power supply 123 adapted to supply electrical power to the internal electronic circuit 118 and other electrical components of the electronic circuit breaker 100.

The circuit breaker 100 includes an unlock mechanism 114 operable to cause contact with the moveable contact arm 108 and block motion of the moveable main electrical contact 112M. The unlock mechanism 114 has a lockout latch 116 having one or more pivot joints 117A, 117B operatively pivotal about a pivot axis 117 or a first end, a moveable stop 124 on a second end, a bias spring 128, and an engagement portion 120 offset from the pivot axis 117 along a length of the lockout latch 116, the moveable stop 124 being adapted to contact the moveable contact arm 108 (See FIG. 1A). The lockout latch 116 includes a first leg and a second leg, each of the first and second legs include a pivot joint, wherein the engagement portion 120 is positioned between the moveable stop 124 and the first and second legs. The first leg and a second leg may each be coupled to a respective pin forming the pivot joints 117A, 117B, where the pins are received through a hole in each of the legs, and are fixed in the portions of the housing 102. Each of the first leg and the second leg may include parallel mounting faces at the pivot joints 117A, 117B.

Figure 2:
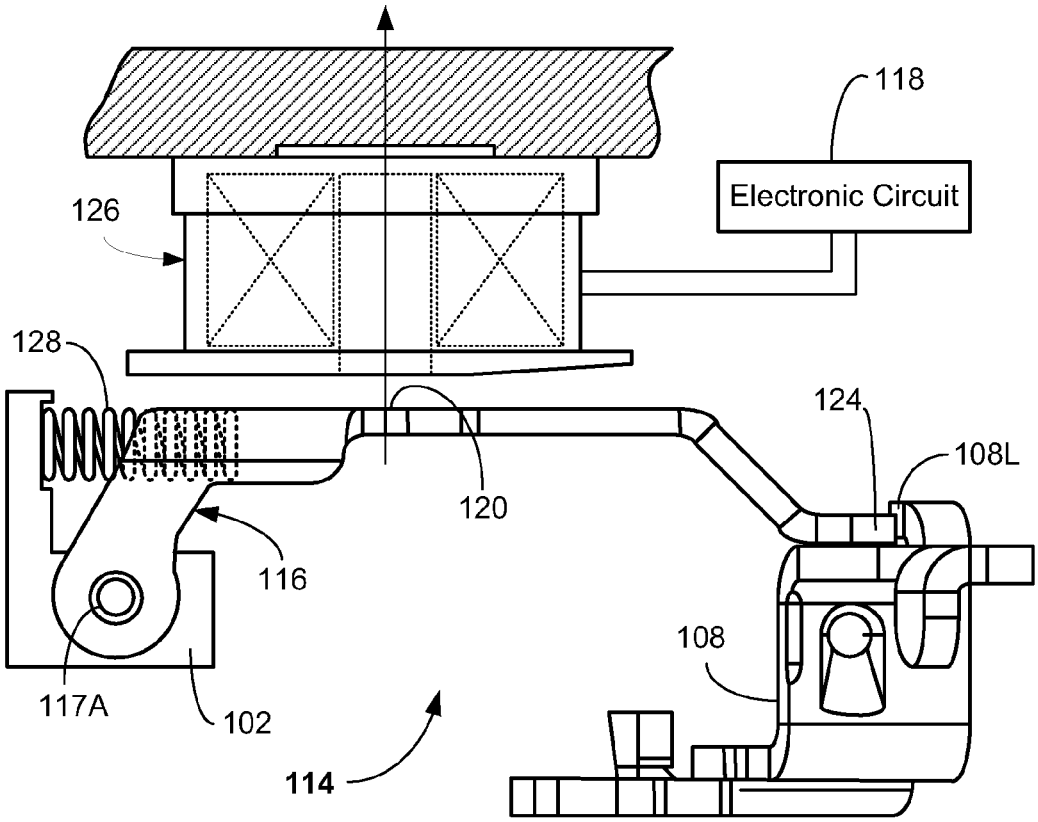

As shown in FIGS. 2 and 3, the unlock mechanism 114 also includes an unlock actuator 126 operative to provide an unlock force at the engagement portion 120. The unlock force may be a magnetic attraction force on the lockout latch 116 causing pivoting of the lockout latch 116 about the pivot axis 117 as shown in FIG. 3. This pivotal motion releases the moveable contact arm 108 as shown in FIG. 1B thereby allowing the stationary main contact 112S and moveable main contact 112M to close. The unlock actuator 126 may be any suitable actuator, such as an electromagnet or solenoid. The solenoid shown in FIGS. 2 and 3 includes a core surrounded by coil windings. The lockout latch 116 may be ferromagnetic (e.g., steel) or include a ferromagnetic portion at the engagement portion 120.

In the depicted embodiment, the movable contact arm 108 may include an extension member 108L that is adapted to interact with the moveable stop 124 so as to lock (e.g., block) the contact arm 108 from continued motion at certain times during the operation of the circuit breaker 100. The extension member 108L may be formed as a tab extending from a body of the moveable contact arm 108, for example. However, any suitable structure for the extension member 108L that may be contacted by a moveable stop 124 may be used. For example, in an alternative embodiment, the body of the contact arm 108 may be contacted directly. Other suitable constructions of the locking and unlocking mechanism may be used, such as is described in U.S. Pub. No. 2009/0189719.

Again referring to FIG. 2, as the handle 104 is moved towards the ON configuration from the OFF configuration, the moveable stop 124 is configured, positioned, and operable to contact and engage the extension member 108L. The moveable stop 124 is normally positioned in a blocking orientation via the spring force exerted by the bias spring 128. The normal motion path of the contact arm 108 as the handle 104 moves towards the ON configuration causes contact between the extension member 108L and the moveable stop 124 and blocks and locks the contact arm 108 in a fixed, opened position as shown in FIG. 2. This locking action maintains separation of the main electrical contacts 112 initially in the unreleased ON configuration.

The moveable stop 124 is operable to disengage the contact arm 108 responsive to a signal provided from the electronic circuit 118 to allow closing of the main electrical contacts 112 (see FIG. 1B). For example, the closing of the main contacts 112 may be predicated upon successful completion of a self test of the electronic circuit 118 and/or connected circuit breaker electrical components.

According to another aspect, it should be recognized that secondary electrical contacts 121, as shown in FIGS. 4A-4C, may come into contact with each other only in the ON configuration (both the unreleased ON (FIG. 1A) and the released ON (FIG. 1B) configurations). Moreover, once in the released ON configuration, the secondary electrical contacts 121 may continue to be engaged in electrical contact via the force provided by the main spring 110 (FIG. 1B). In some embodiments, the secondary electrical contacts 121 only engage each other during the ON configurations (both unreleased and released ON) and are disengaged from each other while in other configurations (OFF, TRIP, and RESET).

When in the unreleased ON configuration (FIG. 1A) in some embodiments, a self test may be initiated responsive to power being provided to the internal electronic circuit 118 by a suitable power supply 123. For example, the self test may be as described in U.S. Pat. No. 7,936,543, the disclosure of which is hereby incorporated by reference herein. Other suitable self testing of the health of the electrical circuit 118, one or more circuit breaker electronic components connected to the electrical circuit 118, or the fault detection sub-circuit (s) of the electrical circuit 118 may be performed.

As shown in FIGS. 1A-1B and 4A-4C, closing the secondary electrical contacts 121 supplies current from the power terminal 105, through conductors 131 and 133 connected to the stationary main contact 112*s*, and conductor 134 to the power supply 123. Conductor 131 may pass through a component of the electronic circuit 118 (e.g., a sensor such as a differential current transformer), for example. The dotted line on the electronic circuit 118 is meant to indicate that the conductor 131 may pass through such a sensor. Optionally, the conductor 131 may extend directly to the stationary main contact 112S.

As shown in FIGS. 4A-4C, closing of the secondary electrical contacts 121 may be accomplished by an extension portion 104E of the handle 104 contacting a leaf spring 132 coupled to the moveable electrical contact 121M. This contact operates against a spring force provided by leaf spring 132 that normally keeps the contacts 116S and 116M in an opened, non-contacting condition. Upon supplying power to the power supply 123 and the internal electronic circuit 118 by closing the secondary electrical contacts 121, an automatic self test routine may be initiated. The self test may automatically initiate a testing sequence that functions to test the operability and ability of the electronic circuit 118 and/or circuit breaker components connected to the electronic circuit 118 (e.g., sensor and/or actuators) to detect faults (e.g., arc faults, ground faults, or the like).

If established test criteria is met during the self test (e.g., test passed), then a signal may be sent from the electronic circuit 118 to the unlock actuator 126 to pivot the unlock latch 116, as shown in FIG. 3, thereby moving the moveable stop 124 from the lock member 108L and unlocking and releasing the moveable contact arm 108. The unlock actuator 126 may operate against the bias force provided by the bias spring 128, whereas the bias spring 128 normally provides the moveable stop 124 in a blocking positional orientation. If the self test is failed, thereby indicating a failed electrical component and/or electronic circuit 118, then no signal may be provided. Accordingly, when a self test failure is detected, the moveable stop 124 continues to block/lock the moveable contact arm 108. After a failed self test and locking of the moveable contact arm 108, when the user releases the handle 104, the handle 104 and other circuit breaker components will return to the OFF configuration. Accordingly, this indicates that all power is turned off to the protected electrical circuit branch after the self test failure. Advantageously, the present invention provides the ability to provide a fail-safe feature to the circuit breaker 100 such that the main electrical contacts 112 cannot be closed until a suitable self test of the electronic circuit 118 and/or electrical components is passed. The unlock mechanism 114 provides a compact and efficient means to unlock the contact arm 108.

Optionally, the electronic circuit breaker 100 may include a push-to-test button (not shown) to initiate a self test once the electronic circuit 118 is energized in the unreleased ON configuration (FIG. 1A). Once the self test is passed, then the electronic circuit 118 may send a signal to the unlock actuator 126 to release the moveable contact arm 108 (FIGS. 1B and 3) and allow the main electrical contacts 112 to close. Furthermore, the electronic circuit breaker 100 may include one or more status indicators, such as LEDs (not shown), to indicate the existence of a failed electronic circuit 118 if the self test is failed, or otherwise indicate a detected fault condition when the circuit breaker 100 is in operation and coupled to a protected electrical circuit branch.

Once the self test is passed, and the circuit breaker 100 is released to the released ON configuration shown in FIG. 1B, tripping mechanisms including mechanical, electromechanical and material components to accomplish circuit breaker tripping become operative. For example, a mechanical tripping mechanism 134 as shown in FIGS. 1A-1B may each include a cradle 111, spring 110, armature 136, armature spring 137, magnet 138, and bimetal element 140, as is described in U.S. Pub. No. 2010/0238611 entitled "Low-Profile Electronic Circuit Breakers, Breaker Tripping Mechanisms, And Systems And Methods Of Using Same," the disclosure of which is hereby incorporated by reference herein in its entirety. The electronic tripping mechanism may include the electronic circuit 118, which may be provided on a printed circuit board, and may include one or more sensors that are adapted to sense various current conditions of the connected electrical circuit branch, as well as one or more actuators. The electronic circuit 118 may process the indicative signal (s) from the sensors. In particular, the electronic circuit 118 may execute an algorithm to determine whether an unwanted electrical condition exists in the protected electrical circuit branch, such as an arc fault (serial or parallel), a ground fault, or other unwanted electrical condition, for example.

In some embodiments, a maglatch 136A on the armature 136 may be activated by a maglatch actuator 142 when certain fault criteria are met. Activating the actuator trips the cradle 111 and therefore trips the circuit breaker 100 to a TRIP configuration separating the main contacts 112 and opening the protected electrical circuit branch. The particular algorithms for determining the existence of an unwanted electrical fault condition, and the electronic circuit components of the electronic circuit 118 will not be further described herein, as they are well known in the art. For example, such circuits and fault detection methods may be found in U.S. Pat. Nos. 5,729,145, 5,946,174, 6,617,858, 6,633,824, 7,368,918, 7,492,163, and 7,864,492, the disclosures of each of which are hereby incorporated by reference herein.

As is best illustrated in FIG. 4B, when the handle 104 is first moved to the unreleased ON configuration, the leaf spring 132 is flexed and the attached moveable secondary electrical contact 121M is urged into direct contact with the stationary secondary contact 121S. This closes the path between the conduit 133 and conduit 134 and provides power to the power supply 123 of the electronic circuit 118 and various electrical components (e.g., the unlock actuator 126 and the maglatch actuator 142).

FIG. 1B and 40 illustrate the circuit breaker 100 in the released ON configuration. For example, this may be after a self test has been passed. In this configuration, the moveable stop 124 has been retracted by unlock actuator 126 thereby compressing bias spring 128 and releasing the moveable contact arm 108. Once released by the moveable stop 124, the moveable contact arm 108 pivots and moves due to the spring force exerted by spring 110 to the released ON configuration shown. In the released ON configuration, the moveable main electrical contact 112M on the contact arm 108 comes into direct physical, and electrical contact with the stationary main electrical contact 112S. This closes the main electrical contacts 112, completes the circuit, and allows power from the power terminal 105 to pass through the main contacts 112 into the contact arm 108 then through the other components in the electrical path and to the load terminal 106.

FIGS. 5A and 5B illustrate an alternative embodiment of a circuit breaker with many components not shown for clarity. The other components are the same as in FIGS. 1A-1B. In accordance with another aspect, a secondary contact assembly 550 of the circuit breaker is shown. The secondary contact assembly 550 may function, upon closure of the secondary contacts 121 to power an internal electronic circuit (e.g., electronic circuit 118) or initiate a self test as described herein. The assembly 550 includes a leaf spring 532 that is positioned and functional to be flexed by contact with a cam 555. The leaf spring 532 includes a moveable secondary electrical contact 121M coupled thereto. The depicted leaf spring 532 has a first portion 532A extending in a first direction, and a second portion 532B extending in a second direction different from the first direction. The portions 532A, 532B may be generally straight. The second direction may be generally opposite from the first direction so that the two portions 532A, 532B may at least partially overlap. In the depicted embodiment, the moveable secondary electrical contact 121M is attached to the second portion 532B, such as at an end thereof. In contrast to the previous embodiment, wherein the leaf spring 132 is operatively contacted by the handle 104 such as by a handle extension 104E, in the present embodiment, the leaf spring 132 is operatively contacted by the cam 555. Similarly, the cam 555 is operatively contacted by the handle 104, such as by a handle extension 104E.

As shown in FIG. 55, as the handle 104 is rotated towards the ON configuration, the handle extension 104E contacts the cam 555 and rotates the cam 555 about a cam pivot 555P. Cam pivot 555P may be formed from one or more projections received in a portion of the housing (not shown), or projections extending from the housing received in a hole formed in the cam 555. Other suitable pivot forming means may be provided, such as step screws or step rivets. Rotation of the cam 555 by handle causes the cam 555 to flex the leaf spring 532 from the original configuration to a flexed. condition. This flexing causes the moveable electrical contact 121M to come into contact with the stationary secondary electrical contact 121S. This completes the electrical circuit and may provide, as previously described, power to a power supply (e.g., power supply 123). Because of the relatively long length of the two-portion leaf spring 532, and the use if a cam 555, the spring force against the handle 104 is significantly reduced. Accordingly, the spring force of the leaf spring 132 does not appreciably detract from the spring force provided by the main spring 110. Thus, good contact pressure may be provided between the main electrical contacts 112.

FIG. 6 is a flowchart illustrating a method of operating an electronic circuit breaker 100 according to another aspect. The method 600 includes providing a moveable contact arm (e.g., contact arm 108) having a moveable main electrical contact (e.g., moveable main contact 112M) in 602. In 604, an unlock mechanism (e.g., lockout mechanism 114) is provided having a lockout latch (e.g., lockout latch 116) having one or more pivot joints (e.g., pivot joints 117A, 117B) operatively pivotal about a latch pivot axis (e.g., axis 117) on a first end, a moveable stop (e.g., moveable stop 124) on a second end, an engagement portion (e.g., engagement portion 120) offset from the pivot axis, and an unlock actuator (e.g., unlock actuator 126), the moveable stop being adapted to contact the moveable contact arm. In 606, the unlock actuator is actuated to provide an unlock force at the engagement portion causing pivoting of the lockout latch about the pivot axis and movement of the moveable stop thereby releasing the moveable contact arm to a closed configuration. Accordingly, this releases the contact arm 108 and under the force of the main spring 110, closes the main contacts 112.

It should now be apparent that utilizing the electronic circuit breaker 100 provides the ability to lock the moveable contact arm 108 when in the ON configuration. The contact arm 108 may be unlocked when a self test is passed, for example. Additionally, efficient unlock mechanisms and secondary contact assemblies are provided.

While the invention is susceptible to various modifications and alternative forms, specific embodiments and methods thereof are shown by way of example in the drawings and are described in detail herein. It should be understood, however, that the invention is not limited to the particular apparatus, systems, or methods disclosed, but, to the contrary, the intention is to cover all modifications, equivalents, and alternatives falling within the spirit and scope of the invention.

What is claimed is:

1. An electronic circuit breaker, comprising:

main electrical contacts configurable between an opened and closed condition, the main electrical contacts including a moveable main electrical contact coupled to a moveable contact arm;

a handle coupled to the moveable contact arm to enable movement of the moveable contact arm, the handle moveable between at least an OFF configuration an ON configuration;

secondary electrical contacts configured to engage each other when the handle is in the ON configuration, the secondary electrical contacts including a moveable secondary electrical contact; and a leaf spring operably supporting the moveable secondary electrical contact, the leaf spring configured to be flexed to close the secondary electrical contacts in the ON configuration; wherein the moveable secondary electrical contact and the moveable main electrical contact are not the same.

2. The circuit breaker of claim 1, comprising a cam configured and operable to contact the leaf spring, the cam being configured and operable to be contacted by the handle.

3. The circuit breaker of claim 1, wherein the leaf spring comprises a first portion extending in a first direction and a second portion extending in a second direction generally opposite from the first direction, wherein the moveable secondary electrical contact is attached at to the second portion.

* * * * *